US006211504B1

(12) United States Patent
Lee

(10) Patent No.: US 6,211,504 B1
(45) Date of Patent: Apr. 3, 2001

(54) WALL-MOUNTED MICROWAVE OVEN AND METHOD FOR CONTROLLING HOOD MOTOR THEREFOR

(75) Inventor: Sung-Ho Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/521,941

(22) Filed: Mar. 9, 2000

(30) Foreign Application Priority Data

Mar. 9, 1999 (KR) ..... 99-7718
Mar. 9, 1999 (KR) ..... 99-7720

(51) Int. Cl.[7] ..... H05B 6/80; H05B 6/68

(52) U.S. Cl. ..... 219/757; 219/702; 219/718; 126/273 A; 126/299 D

(58) Field of Search ..... 219/702, 716, 219/718, 757, 715; 126/21 A, 273 A, 299 R, 299 D; 361/694, 695

(56) References Cited

U.S. PATENT DOCUMENTS 5,268,547 12/1993 Bessyo et al. ..... 219/716
5,942,145 8/1999 Jeon et al. ..... 219/757
5,986,245 11/1999 Kang ..... 219/757
6,025,582 * 2/2000 Kang et al. ..... 219/757
6,072,169 * 6/2000 Kang et al. ..... 219/702

* cited by examiner

*Primary Examiner*—Philip H. Leung
(74) *Attorney, Agent, or Firm*—Robert E. Bushnell, Esq.

(57) ABSTRACT

A wall-mounted microwave oven and a control method for controlling a hood motor are provided. Here, the wall-mounted microwave oven having a main body forming a cavity for accommodating foods to cook, a casing enclosing the main body and forming a hood duct having an inlet located on a bottom area and an outlet located on an upper area, and a hood fan installed in the hood duct, includes a hood motor driving the hood fan, a first switching portion for switching a current supplied from an external electrical power source to the hood motor, and a microcomputer for controlling the rotational speed of the hood motor by adjusting an on/off time of the first switching portion, based on an external control signal. Thus, since the speed of the hood fan can be varied, conveniences of users can be achieved.

24 Claims, 6 Drawing Sheets

WALL-MOUNTED MICROWAVE OVEN AND METHOD FOR CONTROLLING HOOD MOTOR THEREFOR

CLAIM OF PRIORITY

This application makes reference to, incorporates the same herein, and claims all benefits accruing under 35 U.S.C. §119 from my two applications WALL MOUNTED TYPE MICROWAVE OVEN AND HOOD MOTOR SPEED CONTROLLING METHOD THEREOF filed with the Korean Industrial Property Office on Mar. 9, 1999 and there duly assigned Ser. No. 7718/1999, and WALL MOUNTED TYPE MICROWAVE OVENAND HOOD MOTOR SPEED CONTROLLING METHOD THEREOF filed with the Korean Industrial Property Office on Mar. 9, 1999 and there duly assigned Serial No. 7720/1999.

BACKGROUND OF THE INVENTION

1. Field of the Invention

The present invention relates to a wall-mounted microwave oven and a method for controlling a hood motor, and more particularly, to a wall-mounted microwave oven and a method for controlling a hood motor, to vary the speed of the hood motor.

2. Description of the Related Art

A wall-mounted microwave oven is installed on the upper wall over a gas range, and functions as a hood for inhaling vapor and fumes generated during cooking foods in the gas range and discharging the inhaled vapor and fumes to the outside.

As shown in FIGS. 1 and 2, the wall-mounted microwave oven includes a main body 53 and a casing 56 enclosing the main body 53. Between the casing 56 and the main body 53 is formed a hood duct 65 as a path for discharging vapor and fumes. On the lower surface of the casing 56 is formed an inlet 58 for inhaling vapor and fumes into the hood duct 65. On the upper surface of the casing 56 is formed an outlet 59 to which a discharging tube 61 is connected. The discharging tube 61 is connected to a discharging path 67 which penetrates the wall and communicates with the outside. Also, on the upper portion of the main body 53 adjacent to the outlet 59 is formed a hood fan 63 for discharging the vapor and fumes inhaled in the hood duct 65 via the inlet 58 to the outside via the outlet 59, as indicated by arrow marks.

The hood fan 63 operates by a user's selection through a select button provided in a control panel 35. As it being the case, a hood sensor 57 (FIG. 7) which turns on or off the hood fan 63 according to air temperature or smoke detection is provided to the inlet 58 of the hood duct 65 or the inside thereof, thereby controlling operation of the hood fan 63. Here, the hood sensor 57 is generally made of a bimetal.

FIG. 7 is a circuit diagram of a hood driver for a conventional wall-mounted microwave oven. The hood motor 95 is installed on an electric power line which mutually and serially connects first and second commercial alternating voltage (AC) electric power lines 51 and 52 which extend from an external power source 55. On the electric power line where the hood motor 95 is installed, are formed a hood fan switch 72 which turns on or off the hood motor 95 and a speed select switch 73 for selecting a driving speed of the hood motor 95 at low or high speed. Here, the speed select switch 73 has a high speed contact 73*a* and a low speed contact 73*b* for turning on the hood motor 95, with a result that the hood motor 95 operates at high speed or at low speed, respectively. The speed selection switch 73 is normally connected to the low speed contact 73*b*.

The hood sensor 57 is connected in parallel with the hood fan switch 72. As described above, the hood sensor 57 detects heat or gases transferred from a gas range 100 and is turned on when heat or gases is detected.

By this configuration, a selection button for driving the hood fan can be selected to discharge heat and fumes emitted from foods during cooking. Here, if a user presses the selection button once, a microcomputer 60 turns on the hood fan switch 72, in which case the speed selection switch ordinarily in contact with the low speed contact 73*b* drives the hood motor 95 at low speed. If the selection button is pressed twice, the microcomputer 60 directs the speed selection switch 73 to contact the high speed contact 73*a* to drive the hood motor 95 at high speed. If the selection button is pressed once again, the microcomputer 60 turns off the hood fan switch 72 to stop the hood motor 95.

Meanwhile, although the user does not manipulate the selection button, if the hood sensor 57 detects heat or fumes during cooking, the hood sensor 57 is turned on to drive the hood motor 95 at low speed.

However, the conventional hood motor 95 can be controlled only at two levels, that is, at low speed and high speed. Thus, if a user wishes the hood motor 95 to be driven faster than at high speed, or wishes the hood motor 95 to be driven at intermediate speed, such user needs cannot be met. That is, the driving speed of the hood motor 95 cannot be adaptively controlled according to the degree of heat or fumes emitted.

To solve these problems, the winding number of coils is increased to enlarge the capacity of the hood motor 95, thereby controlling the rotational speed of the hood motor 95 in multiple steps. In the case that the winding number of coils is increased, the volume of the hood motor 95 also increases. In addition, as the number of steps are increased, the number of contacts in the speed selection switch 73 should be increased. As a result, a production cost increases and an assembling work is complicated.

SUMMARY OF THE INVENTION

To solve the above problems, it is an object of the present invention to provide a wall-mounted microwave oven which is adaptively controlled according to a cooking condition under which the speed of a hood motor is diversified.

It is another object of the present invention to provide a hood motor speed controlling method in a wall-mounted microwave oven which is adaptively controlled according to a cooking condition under which the speed of a hood motor is diversified.

To accomplish the above object of the present invention, there is provided a wall-mounted microwave oven having a main body forming a cavity for accommodating foods to cook, a casing enclosing the main body and forming a hood duct having an inlet located on a bottom area and an outlet located on an upper area, and a hood fan installed in the hood duct, the wall-mounted microwave oven comprising: a hood motor driving the hood fan; a first switching unit for interrupting a supply current supplied to the hood motor, a hood sensor connected in parallel with the first switching unit, said hood sensor detecting whether or not the hood fan need to be turned on or off; a microcomputer for controlling the rotational speed of the hood motor by controlling an on and-off time of the first switching unit, in response to an external control signal; and a second switching unit transmitting a control signal supplied from the microcomputer to the first switching unit.

Preferably, the wall-mounted microwave oven further comprises a rectifying unit rectifying the supply current supplied from a power unit.

Preferably, the wall-mounted microwave oven further comprises a filtering unit connected between the first switching unit and the hood motor, each end of the filtering unit connected to the rectifying unit, the filtering unit filtering rectification current rectified in the rectifying unit.

Preferably, the first switching unit comprises a transistor.

The wall-mounted microwave oven further comprises a second switching unit for transmitting a control signal supplied from the microcomputer to the first switching unit. The second switching unit comprises a first transistor connected to the microcomputer and turned on or off according to a driving signal supplied from the microcomputer and a second transistor operating reversely to the on-and-off operation of the first transistor and transmitting a driving signal to the first switching unit.

Preferably, when the speed of the hood motor is increased, the first switching unit is controlled to have a short duty cycle.

Preferably, the wall-mounted microwave oven further comprises a selection switch connected serially to said hood sensor, having a first pole connected to said hood sensor and a second pole connected to said first switching unit.

Also, the wall-mounted microwave oven further comprises a speed control button for controlling the speed of the hood motor externally. The wall-mounted microwave oven preferably comprises a hood sensor provided on an electrical line connected in parallel with the first switching unit, for detecting whether or not the hood fan needs to operate, and a selection switch serially connected to the hood sensor on the electrical line, having a first contact connected to the hood sensor and a second contact connected to the first switching unit. Preferably, the selection switch is set to contact the first contact in a normal case, and to contact the second contact if a user selects a hood fan speed button when the hood fan is turned on by a detection signal supplied from the hood sensor.

Meanwhile, the wall-mounted microwave oven further comprises a rectifying unit for rectifying a supply current supplied from the power supply unit, and a first filtering unit disposed in parallel between the rectifying unit and the hood motor, for filtering the rectification current rectified in the rectifying unit by increasing the rectification current by a predetermined level. The wall-mounted microwave oven further comprises a second filtering unit disposed in parallel between the rectifying unit and the first filtering unit, for filtering the rectification current rectified in the rectifying unit, and speed change switch disposed between the first filtering unit and the hood motor, for selecting a filtering current from the second filtering unit to be transferred to any one of the first filtering unit or the hood motor.

Here, the first and second filtering units are formed of a capacitor, respectively, in which it is preferable that a capacity of the first filtering unit is larger than that of the second filtering unit. It is also preferable that the speed change switch transfers the rectification current from the rectifying unit to one of the first and second filtering units.

In addition, the wall-mounted microwave oven comprises a turbo selection button for selecting the speed of the hood motor to be driven at a predetermined level or higher, in which the microcomputer controls the speed change switch to be connected to the first filtering unit when the turbo selection button is selected, and the microcomputer controls the on-and-off time of the first switching unit to control the speed of the hood motor.

Here, the wall-mounted microwave oven preferably comprises a hood sensor provided on an electrical line connected in parallel with the first switching unit, for detecting whether or not the hood fan needs to operate, and a selection switch serially connected to the hood sensor on the electrical line, having a first contact connected to the hood sensor and a second contact connected to the first switching unit. Preferably, the selection switch is set to contact the first contact in a normal case, and to contact the second contact if a user selects a hood fan speed button when the hood fan is turned on by a detection signal supplied from the hood sensor.

According to another aspect of the present invention, there is also provided a hood motor speed controlling method in a wall-mounted microwave oven having a main body forming a cavity for accommodating foods to cook, a casing enclosing the main body and forming a hood duct having an inlet located on a bottom area and an outlet located on an upper area, a hood fan installed in the hood duct, and a hood motor for driving the hood fan, the hood motor speed controlling method comprising the steps of: generating a driving signal to be supplied to the hood motor based on an external control signal; and controlling a duty cycle of the current to be supplied to the hood motor according to the driving signal to thereby control the speed of the hood motor.

Here, the step of controlling the speed of the hood motor further comprises of the step of lengthening the duty cycle in the case that the speed of the hood motor is increased.

Also, the hood motor speed controlling method further comprises the step of amplifying the current to be supplied to the hood motor from the external electrical power source. The step of supplying the current to the hood motor is preferably a step of controlling a duty cycle of the amplified current to be supplied to the hood motor.

Preferably, the hood motor speed controlling method further comprises the steps of filtering the current to be supplied to the hood motor, amplifying the filtered current, and selecting the filtered current so as to be directly supplied to the hood motor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Preferred embodiments of the present invention will be described in detail with reference to the accompanying drawings.

Figure 1:
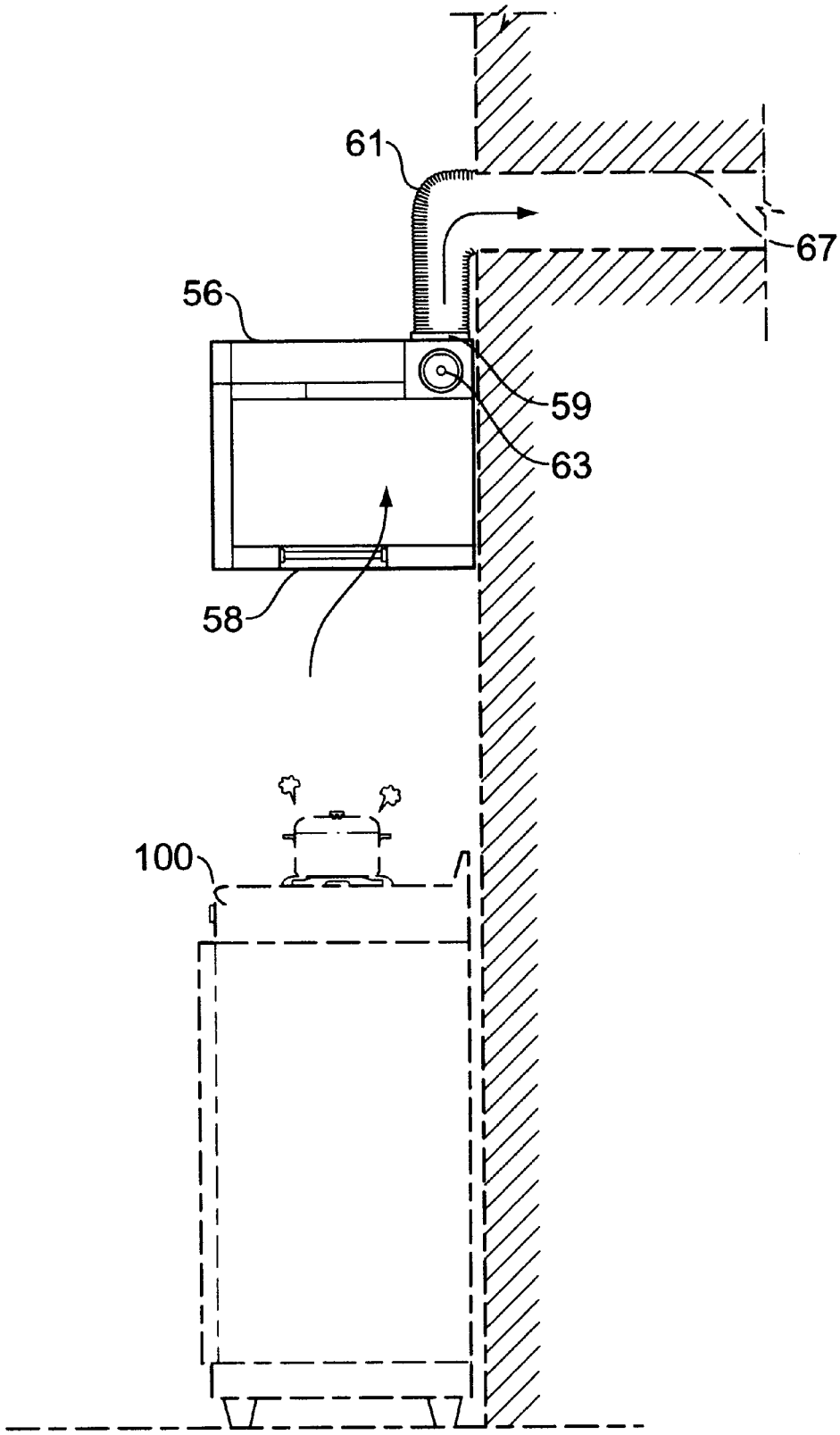
FIG. 1 is a schematic view of a wall-mounted microwave oven installed above a gas range.
Figure 2:
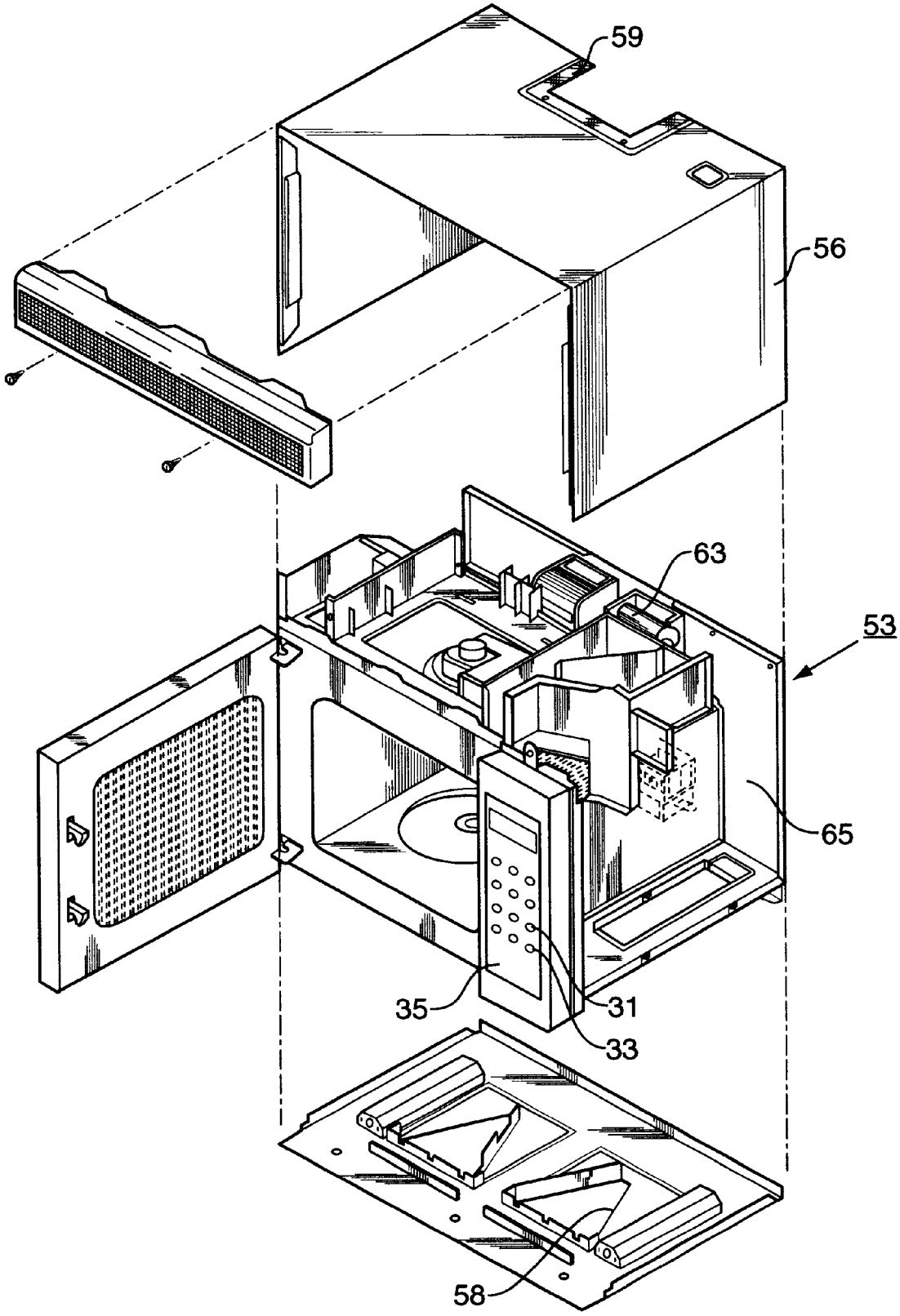
FIG. 2 is a partially exploded perspective view of a wall-mounted microwave oven.

The wall-mounted microwave oven according to the present invention has the same configuration as those of FIGS. 1 and 2 in external appearance. Thus, the detailed description thereof will be omitted.

Figure 3:
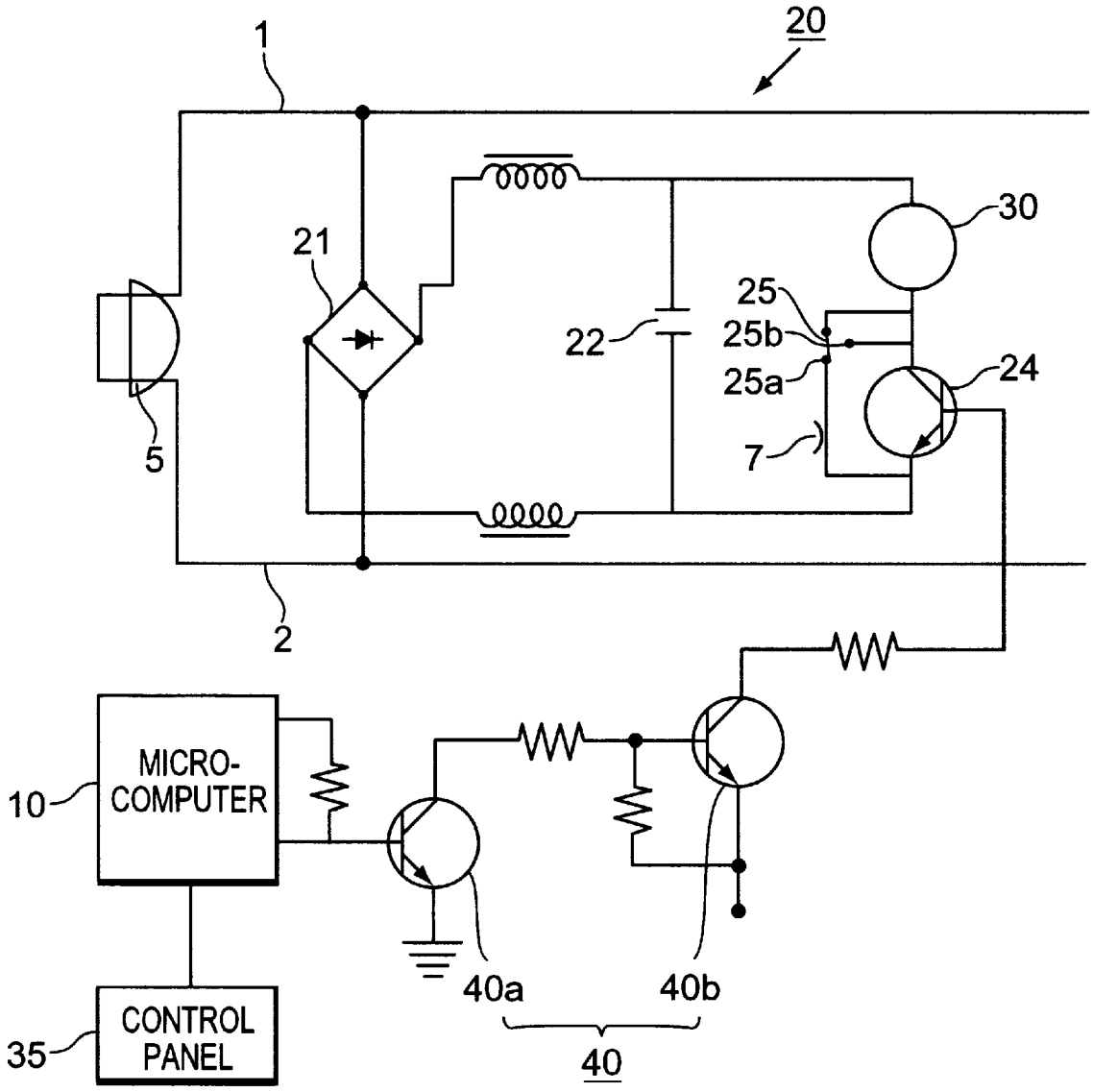
FIG. 3 is a circuit diagram of a hood driver in a wall-mounted microwave oven according to a first embodiment of the present invention.
Figure 4:
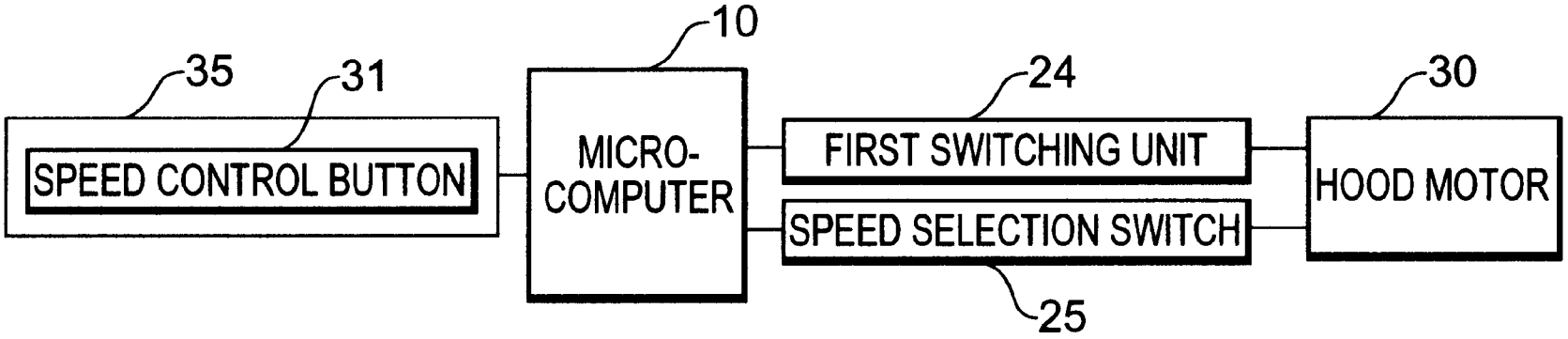
FIG. 4 is a control block diagram of the wall-mounted microwave oven of FIG. 3.

FIG. 3 is a circuit diagram of a hood driver 20 in a wall-mounted microwave oven according to the present invention, and FIG. 4 is a control block diagram of the wall-mounted microwave oven of FIG. 3. As illustrated, the hood driver 20 includes a hood motor 30 formed of a direct current (DC) motor, a switching unit for interrupting a power supply for the hood motor 30, and a microcomputer 10 for providing a control signal to the switching unit to control speed of the hood motor 30. Here, the hood motor 30 is supplied with a rectified and filtered current via a rectifier 21 disposed on an electrical power line serially connecting first and second commercial electrical power lines 1 and 2 which extend from an electrical power source 5 and a filtering unit 22 connected in parallel with the rectifier 21.

Meanwhile, the switching unit includes a first switching unit 24 which is turned on or off according to a driving signal supplied from the microcomputer 10, and a hood sensor 7 connected in parallel with the first switching unit 24, for detecting heat and/or fumes within a hood duct in which the hood sensor 7 is turned on or off according to a detection result.

The first switching unit 24 is formed of an npn type transistor whose base electrode is connected to the microcomputer 10 in order to receive a driving signal from the microcomputer 10. A second switching unit 40 for transferring the driving signal from the microcomputer 10 to the first switching unit 24 is connected between the microcomputer 10 and the first switching unit 24. The second switching unit 40 includes a first transistor 40*a*, which is connected to the microcomputer 10 and is turned on or off according to a signal from the microcomputer 10 and a second transistor 40*b* for transferring a driving signal to the first switching unit 24 when the first switching unit 40*a* is turned on. Here, both the transistor of the first switching unit 24 and the first transistor 40*a* are formed of an npn type transistor, respectively so as to be turned on or off according to an identical signal and the second transistor 40*b* is formed of a pnp type transistor.

As a result, if a low signal is generated from the microcomputer 10, the second transistor 40*b* is turned on and both the first transistor 40*a* and the first switching unit 24 are turned off, so that a current supply is cut off toward the hood motor 30. Reversely, if a high signal is generated from the microcomputer 10, the second transistor 40*b* is turned off and both the first transistor 40*a* and the first switching unit 24 are turned on, so that a current is supplied to the hood motor 30.

In this manner, if a duty cycle is altered by adjusting a time during which the first switching unit 24 is turned on or off, in accordance with the signal supplied from the microcomputer 10, the magnitude of the current supplied to the hood motor 30 is varied according to the duty cycle. That is, if a time during which the first switching unit 24 is turned on is lengthened, the magnitude of the current supplied to the hood motor 30 becomes larger, so that the rotational speed of the hood motor 30 becomes faster. On the contrary, if a time during which the first switching unit 24 is turned on is shortened, the magnitude of the current supplied to the hood motor 30 becomes smaller, so that the rotational speed of the hood motor 30 becomes slower. Meanwhile, a speed control button 31 for adjusting the rotational speed of the hood motor 30 is provided in an external control panel 35. The speed control button 31 can be formed of a knob according to the specification of the wallmounted microwave oven.

Meanwhile, on an electrical power line where the hood sensor 7 is installed is provided a selection switch 25 having a first contact 25*a* connected to the hood sensor 7 and a second contact 25*b* connected to the first switching unit 24. The selection switch 25 is selectively connected to one of the hood sensor 7 and the first switch 24. Accordingly, if the hood sensor 7 is turned on, an electrical power is supplied to the hood motor 30 to be rotated. If a user selects the speed control button 31 while the hood motor 30 is driven according to the activation of the hood sensor 7, the microcomputer 10 controls the selection switch 25 to contact the second contact 25*b* and controls a current supply to the first switching unit 24, with a result that the speed of the hood motor 30 can be adjusted.

As shown in FIG. 4, the microcomputer 10 in the microwave oven having the hood motor 30 controls a connection between the first switching unit 24 and the selection switch 25 according to a user's control of the control panel 35 at the time when an electric power is applied from the electric power supply 5. Accordingly, the rotational speed of the hood motor 30 is controlled.

By the above configuration, if a user selects the speed control button 31 in order to drive the hood fan during using of a gas range, the microcomputer 10 sends the driving signal to the first switching unit 24. Then, the microcomputer 10 controls the on-and-off time of the first switching unit 24 according to the control of the speed control button 31, to thereby control a quantity of current applied to the hood motor 30. As a result, the rotational speed of the hood motor 30 is changed.

Although a user does not select the speed control button 31, if the hood sensor 7 detects heat or fumes, the hood sensor 7 is turned on, accordingly the current is supplied to the hood motor 30. Thus, the hood motor 30 is driven. Here, when the hood sensor 7 is turned on, the hood motor 30 rotates at an appropriate speed which is preset in the microcomputer 10. Even though the hood motor 30 is driven by the hood sensor 7, if the user selects the speed control button 31, the microcomputer 10 controls the selection switch 25 to contact the second contact 25*b* to apply the current to the first switching unit 24. By so doing, the hood motor 30 can operate at a user's desired rotational speed according to control of a user.

As described above, the present invention is provided with the first switching unit 24 to control the rotational speed of the hood motor 30, and the speed control button 31 for selecting the rotational speed of the hood motor 30 in the control panel 35. Thus, the rotational speed of the hood motor 30 can be linearly varied within the speed interval between a high speed and a low speed.

Accordingly, since a user can drive the hood fan at a desired speed according to a degree of heat and/or fumes to be discharged, ventilation and exhaust can be accomplished within an optimal time, to thereby provide users with conveniences.

Figure 6:
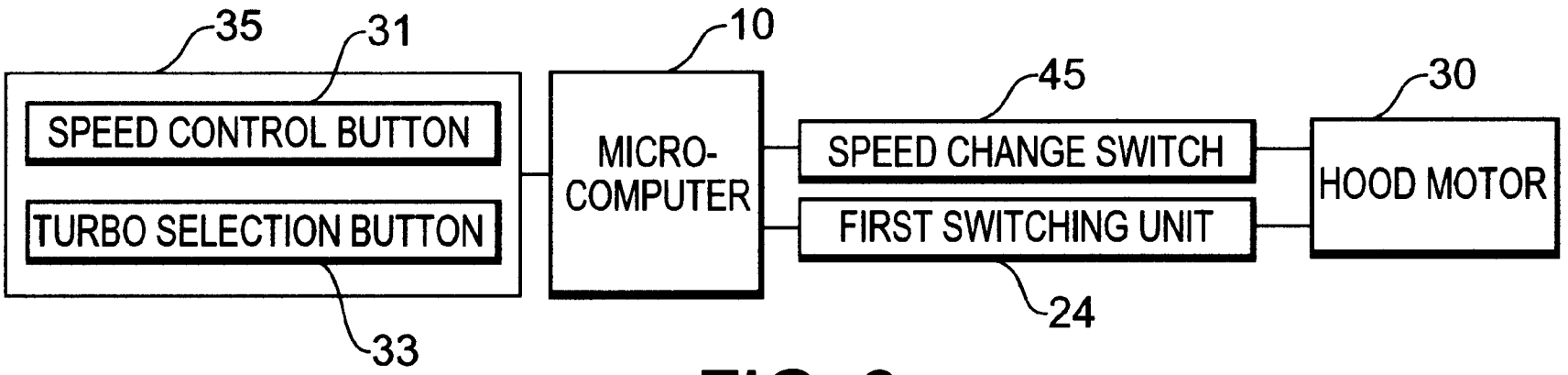
FIG. 6 is a control block diagram of the wall-mounted microwave oven of FIG. 5.
Figure 5:
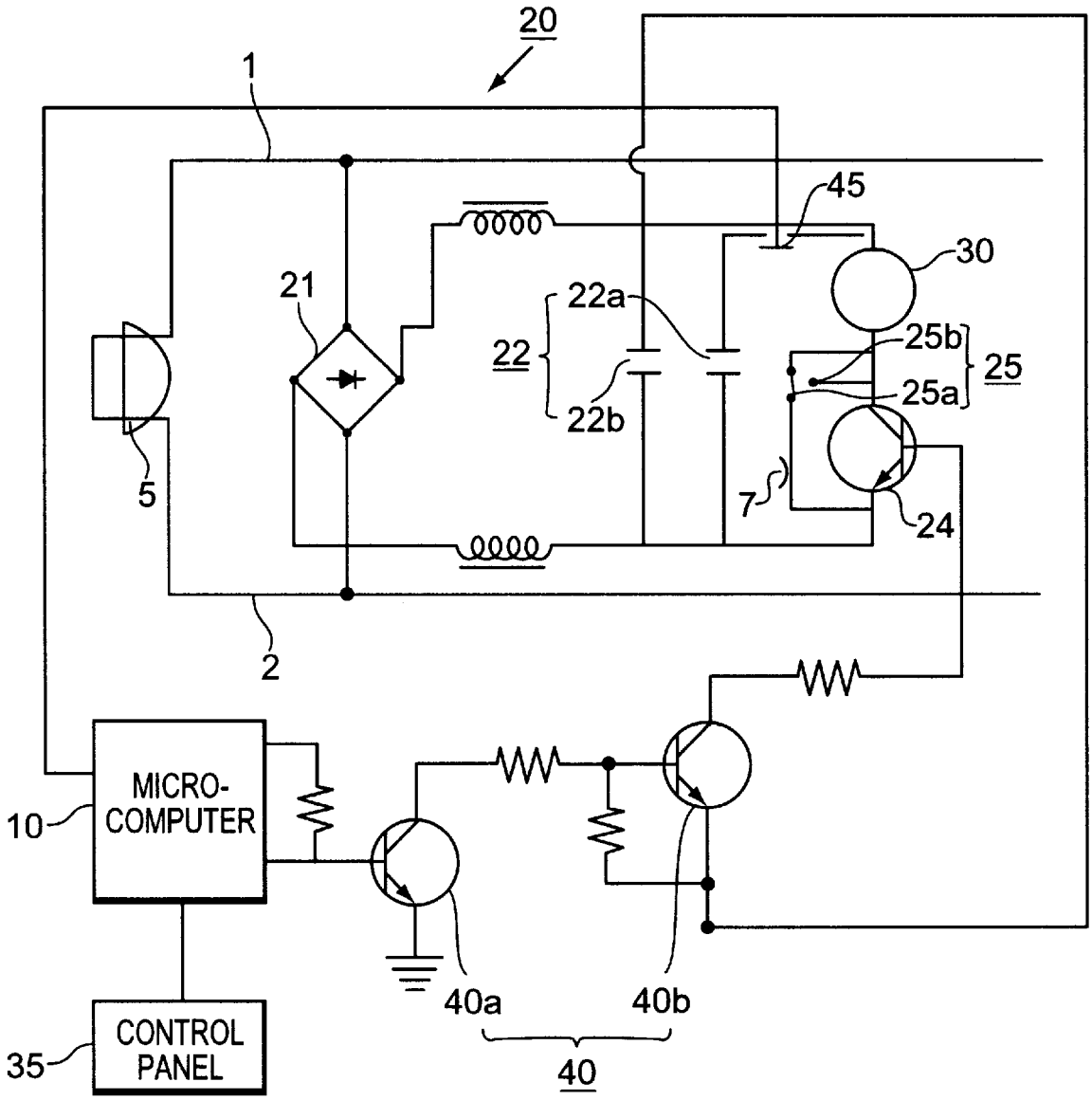
FIG. 5 is a circuit diagram of a hood driver of a wall-mounted microwave oven according to a second embodiment of the present invention.
Figure 7:
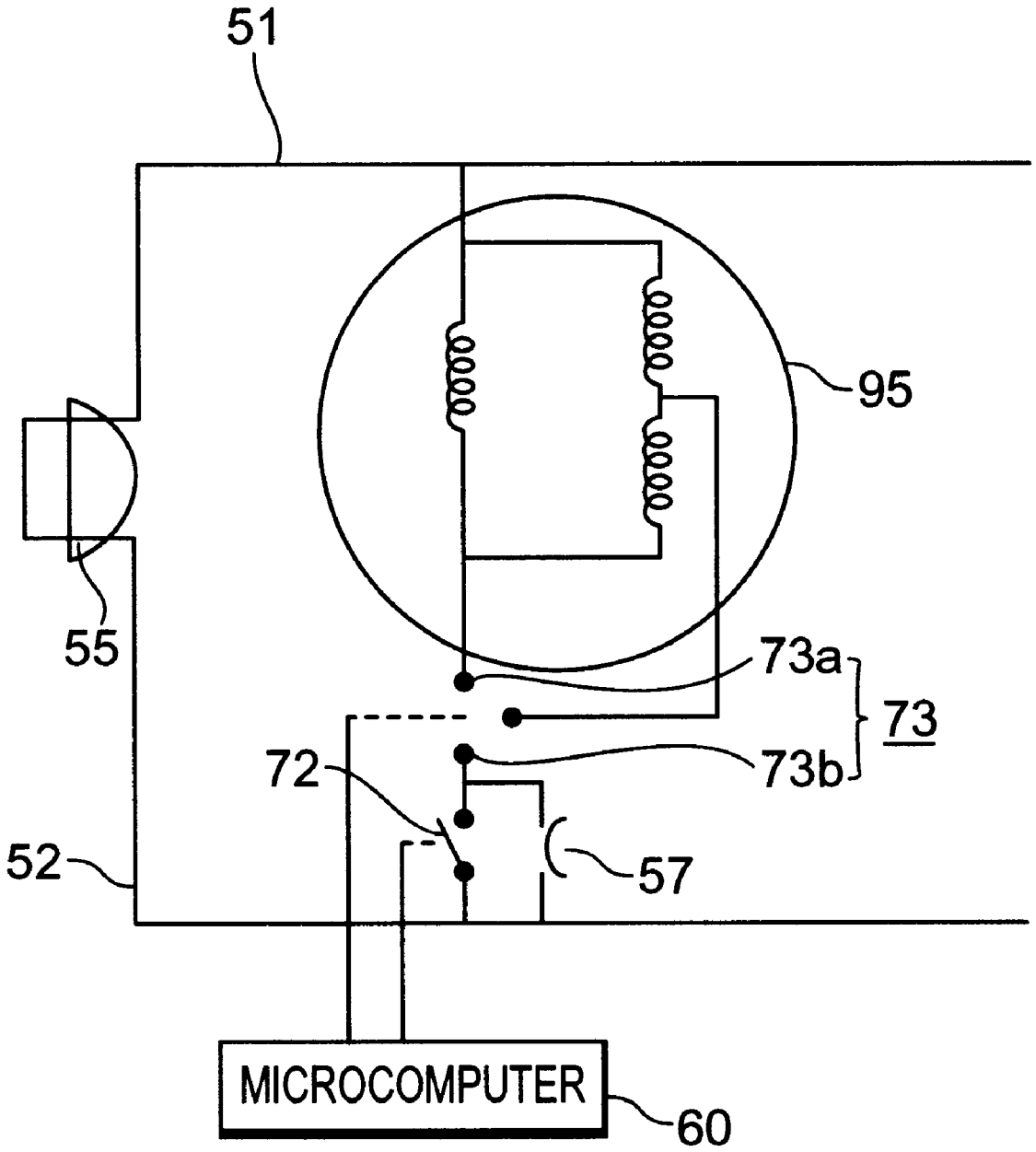
FIG. 7 PRIOR ART
FIG. 7 is a circuit diagram of a conventional wall-mounted microwave oven.

FIG. 5 is a circuit diagram of a hood driver of a wall-mounted microwave oven according to a second embodiment of the present invention, and FIG. 6 is a control block diagram of the wall-mounted microwave oven of FIG. 5. A hood driver 20 for driving a hood motor in a wall-mounted microwave oven according to a second embodiment of the present invention shown in FIG. 5 is the same as the basic configuration of the first embodiment shown in FIG. 3. Thus, the detailed description of the elements which are assigned with the same reference numerals as those of the first embodiment will be omitted.

In the second embodiment of the present invention, a filtering unit 22 includes a second filter 22*b* for filtering the rectified current into an average current and a first filter 22*a* connected in parallel with the second filter 22*b*, for increasing the magnitude of the rectified current by a predetermined level or higher and filtering the rectified current. Here, the second filter 22*b* is connected with the second switching unit 40*b*. Also, a speed change switch 45 is provided between the first filter 22*a* and the hood motor 30. The speed change switch 45 interrupts a power supply to the first filter 22*a*.

As a result, an electric current from the electrical power source 5 is supplied only to the second filter 22*b* in a normal case. If the speed change switch 45 is turned on, the electrical power from the electrical power source 5 is supplied to the first filter 22*a* via the second filter 22*b*. The current after passing the first filter 22*a* is instantly and sharply increased and then supplied to the hood motor 30, to thereby sharply increase the rotational speed of the hood motor 30.

A switching unit of the second embodiment of the present invention has the same configuration as that of the first embodiment. Thus, the detailed description of the elements which are assigned with the same reference numerals as those of the first embodiment will be omitted.

Meanwhile, a control panel 35 is provided with a speed control button 31 which can vary the rotational speed of the hood motor 30 by adjusting the magnitude of the current supplied to the fist switching unit 24 and a turbo selection button 33 for turning on or off the speed change switch 45. The speed control button 31 and the turbo selection button 33 can be formed of a knob according to the specification of the wall-mounted microwave oven.

As shown in FIG. 5, the microcomputer 10 in the microwave oven having the hood motor 30 controls a connection between the first switching unit 24 and the speed change switch 45 according to a control of the speed control button 31 and the turbo selection button 33 from the control panel 35. Accordingly, the rotational speed of the hood motor 30 is controlled.

By the above configuration, if a user selects the speed control button 31 in order to drive the hood fan during using of a gas range, the microcomputer 10 controls the selection switch 25 to contact the second contact 25*b* at the side of the hood motor 30, to thereby send the driving signal to the first switching unit 24. Then, the microcomputer 10 controls the on-and-off time of the first switching unit 24 according to the control of the speed control button 31, to thereby control a quantity of current applied to the hood motor 30. As a result, the rotational speed of the hood motor 30 is changed within a conventional speed range.

If the user selects the turbo selection button 33 while the hood motor 30 is driven within the conventional speed range, the microcomputer 10 controls the speed change switch 45 to be turned on. Accordingly, the magnitude of the current to be supplied to the hood motor 30 is sharply increased to thereby sharply increase the rotational speed of the hood motor 30. Here, if a user controls the speed using the speed control button 31, the rotational speed of the hood motor 30 can be controlled.

Although a user does not select the speed control button 31, the hood sensor 7 is turned on if the hood sensor 7 detects heat or fumes. Accordingly, the current is supplied to the hood motor 30. Thus, the hood motor 30 is driven. Here, when the hood sensor 7 is turned on, the hood motor 30 rotates at an appropriate speed which is preset in the microcomputer 10. Even though the hood motor 30 is driven by the hood sensor 7, if the user selects the speed control button 31, the microcomputer 10 controls the select [selection] switch 25 to contact the second contact 25*b* to apply the current to the first switching unit 24. Also, the hood motor 30 can be driven at an ultra-speed according to a user's selection of the turbo selection button 33.

As described above, the present invention is provided with the first switching unit 24 for controlling the on-and-off time of the current to vary the rotational speed of the hood motor 30. The present invention is also provided with the first filter 22*a* for filtering the current by increasing the current by a predetermined level or higher, to thereby select the rotational speed of the hood motor 30 to a normal speed or an ultra-high speed.

As a result, according to the user's control of the control panel 35, the rotational speed of the hood motor 30 can be linearly varied. The hood motor 30 can be also driven at an ultra-high speed. Thus, ventilation and exhaust can be accomplished within an optimal time, to thereby provide users with conveniences.

Meanwhile, in the second embodiment, the current passing through the second filter is supplied to the first filter. However, the current from the rectifier can be supplied to either of the first and second filters.

As described above, the rotational speed of the hood motor 30 can be linearly varied. The hood motor 30 can be also driven at an ultra-high speed. Thus, ventilation and exhaust can be accomplished within an optimal time, to thereby give conveniences to users.

In the embodiments described above, the speed control button 31 and the turbo selection button 33 are provided in the control panel 35. However, they can be also provided in the other parts of the microwave oven than the control panel 35.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A wall-mounted microwave oven, comprising:

a hood motor connected to a hood fan for driving the hood fan;

a first switching unit connected to said hood motor varying an on-off duty cycle of a supply current supplied to the hood motor;

a hood sensor connected in parallel with said first switching unit, said hood sensor detecting whether or not said hood fan needs to be turned on or off;

a microcomputer allowing manual control of the rotational speed of the hood motor by controlling an on-and-off time of the first switching unit in response to an external control signal from a user; and a second switching unit disposed between said first switching unit and said microcomputer, transmitting a control signal supplied from said microcomputer to said first switching unit.

2. The wall-mounted microwave oven according to claim 1, further comprising a rectifying unit rectifying said supply current supplied from a power unit.

3. The wall-mounted microwave oven according to claim 2, further comprising a filtering unit connected between said first switching unit and said hood motor, each end of said filtering unit connected to said rectifying unit, said filtering unit filtering rectification current rectified in said rectifying unit.

4. The wall-mounted microwave oven according to claim 3, wherein said first switching unit comprises a transistor.

5. The wall-mounted microwave oven according to claim 4, further comprising a control panel connected to said microcomputer to provide a user interface allowing a user to manually control the speed of said hood fan and said hood motor.

6. The wall-mounted microwave oven according to claim 5, further comprising a speed control button connected to said control button controlling the speed of the hood motor by a user.

7. The wall-mounted microwave oven according to claim 5, further comprising a turbo selection button connected to said control panel allowing said hood motor and said hood fan to operate and an ultra-high speed.

8. The wall-mounted microwave oven according to claim 3, said filtering unit comprising a pair of capacitors in parallel disposed between said hood motor and said first switching unit.

9. The wall-mounted microwave oven according to claim 8, further comprising a speed change switch disposed between the pair of capacitors in said filtering unit and the hood motor, applying said rectified current to said hood motor.

10. The wall-mounted microwave oven according to claim 9, said speed change switch is connected to said microcomputer and is applied to said filtering unit.

11. The wall-mounted microwave oven according to claim 1, wherein said second switching unit comprises a first transistor connected to the microcomputer and turned on or off according to said control signal supplied from the microcomputer and a second transistor operating reversely to the on-and-off operation of the first transistor and transmitting a driving signal to the first switching unit.

12. The wall-mounted microwave oven according to claim 1, wherein said microcomputer controls said first switching unit in such a manner that when the speed of said hood motor increases when said first switching unit is controlled by a short duty cycle of said control signal.

13. The wall-mounted microwave oven according to claim 1, further comprising a selection switch connected serially to said hood sensor, having a first pole connected to said hood sensor and a second pole connected to said first switching unit.

14. The wall-mounted microwave oven according to claim 13, wherein said selection switch is set to contact said first pole in the absence of said external control signal, and is set to contact said second pole when said external control signal is applied.

15. A microwave oven, comprising:

a hood fan;

a hood motor connected to said hood fan, driving said hood fan;

a first switching unit connected to said hood motor varying an on-off duty cycle of a supply current supplied to said hood motor;

a hood sensor connected to said first switching unit, said hood sensor automatically detecting whether said hood fan should be turned on or off depending on air temperature and smoke detection about said microwave oven;

a microcomputer controlling manual input of speed of said hood fan;

a control panel attached to said microcomputer, said control panel allowing a user to manually override said hood sensor and to manually adjust the speed of said fan; and a second switching unit disposed between said microcomputer and said first switching unit, said second switching unit controlling signals supplied by said microcomputer to said first switching unit controlling the speed of said hood fan.

16. The microwave oven of claim 15, further comprising a rectifier rectifying power from an electrical power source.

17. The microwave oven of claim 16, further comprising a capacitor filter filtering out power received from said rectifier.

18. The microwave oven of claim 17, further comprising a speed change switch disposed between said microcomputer and said capacitor filter selecting a filtered current from said capacitor filter to be applied to said hood motor.

19. The microwave oven of claim 15, wherein said control panel comprises:

a turbo selection button selecting whether said hood fan is to be driven manually at an ultra-high speed according to a user's selection; and a speed control button manually controlling the speed said hood fan will operate at.

20. The microwave oven of claim 19, further comprising a speed selection switch that determines whether said hood fan is under automatic control from said hood sensor or under manual control from said control panel and said microcomputer.

21. The method of controlling a hood motor driving a hood fan in a microwave oven, comprising the steps of:

providing a microcomputer receiving an external control signal from a user and generating a control signal in response to said external control signal;

generating a driving signal to be supplied to a hood motor based on said control signal from said microcomputer; and controlling a duty cycle of current to be supplied to the hood motor according to said driving signal to thereby control the speed of the hood motor.

22. The method of claim 21, further comprising the step of lengthening the duty cycle in the case that the speed of the hood motor is increased.

23. The method of claim 22, further comprising the step of amplifying the current to be supplied to the hood motor from an external electrical power source.

24. The method of claim 23, further comprising the steps of:

filtering the current to be supplied to the hood motor;

amplifying the filtered current; and selecting the filtered current so as to be directly supplied to the hood motor.

* * * * *